US010233575B2

(12) United States Patent
Nitta et al.

(10) Patent No.: US 10,233,575 B2
(45) Date of Patent: Mar. 19, 2019

(54) ASSISTING TOOL FOR MAKING ORNAMENT

(71) Applicant: CLOVER MFG. CO., LTD., Osaka-shi, Osaka (JP)

(72) Inventors: Kumiko Nitta, Osaka (JP); Katsuhiko Ozeki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 386 days.

(21) Appl. No.: 15/155,900

(22) Filed: May 16, 2016

(65) Prior Publication Data

US 2016/0340807 A1 Nov. 24, 2016

(30) Foreign Application Priority Data

May 19, 2015 (JP) ..... 2015-101954

(51) Int. Cl.
*D04D 7/04* (2006.01)
*D03D 29/00* (2006.01)

(52) U.S. Cl.
CPC ..... *D04D 7/04* (2013.01); *D03D 29/00* (2013.01)

(58) Field of Classification Search
CPC ..... D04D 7/04; D03D 29/00
See application file for complete search history.

(56) References Cited

U.S. PATENT DOCUMENTS 2,292,356 A * 8/1942 Belanger ..... D03D 29/00 28/152
2,607,979 A * 8/1952 Throop ..... D03D 29/00 28/152
2,632,938 A * 3/1953 Kopf ..... D03D 29/00 28/152
3,715,097 A * 2/1973 Kalajian ..... A47B 97/04 248/449
3,769,667 A * 11/1973 Cooper ..... D03D 29/00 28/152
3,800,372 A * 4/1974 Daoust ..... D03D 29/00 28/152
4,046,171 A * 9/1977 Wilson ..... D03D 29/00 139/29
4,088,351 A * 5/1978 Roth ..... D04G 5/00 248/449
6,131,234 A * 10/2000 Chen ..... A47K 7/02 15/209.1
6,666,425 B1 * 12/2003 Ferguson ..... A47G 1/202 248/476

(Continued)

*Primary Examiner* — Shaun R Hurley
(74) *Attorney, Agent, or Firm* — Hamre, Schumann, Mueller & Larson, P.C.

(57) ABSTRACT

An assisting tool is provided for making a tufted ornament having a bunch of threads. The assisting tool includes a first frame and a second frame that form a generally rectangular shape when assembled. The first and second frames have first and second thread hanging portions, respectively, that are spaced apart from each other in a first direction. Each thread hanging portion extends in a second direction perpendicular to the first direction. The assisting tool further includes a length adjuster for adjustably varying the length in the first direction from the first thread hanging portion to the second thread hanging portion by allowing the first and second frames to slide toward or away from each other.

9 Claims, 14 Drawing Sheets

(56) References Cited

U.S. PATENT DOCUMENTS

| | | | | |
|---|---|---|---|---|
| 2008/0173368 | A1* | 7/2008 | Flodin | D03D 29/00 139/33 |
| 2011/0259465 | A1* | 10/2011 | Schaub | D03D 29/00 139/29 |

* cited by examiner

Prior Art

Prior Art

ASSISTING TOOL FOR MAKING ORNAMENT

BACKGROUND OF THE INVENTION

1. Field of the Invention

The present invention relates to an ornament making assisting tool that is suitable to make a tufted ornament, for example.

2. Description of Related Art

In the field of handicraft, tassels are used as ornaments having a decorative effect. To make a tassel, use may be made of an assisting tool as that shown in FIG. 17. The illustrated ornament making assisting tool 9 has two pairs of thread hanging portions, that is, a shorter pair of thread hanging portions 91 and a longer pair of thread hanging portions 92.

A tassel may be made in the following steps, using the ornament making assisting tool 9. First, a thread material, such as an embroidery thread or the like, is wound a predetermined number of times around the shorter or longer pair of thread hanging portions to form loops. In the example shown in FIG. 17, the loops are mound around shorter pair of thread hanging portions 91. Then, as shown in FIG. 18, a ring-shaped suspension cord St having a knot is prepared, and the knot of the suspension cord St is buried in the looped thread Y1. Next, as shown in FIG. 19, a central portion of the looped thread Y1 and the suspension cord St are firmly tied together using another thread Y2. Next, as shown in FIG. 20, a pair of scissors Sc is inserted between the thread hanging portion 91 and the looped thread Y1, to cut the looped thread Y1 at two locations where the thread is wrapped around the pair of thread hanging portions 91 and 91. This cutting provides skirt threads Y3 as shown in FIG. 21A. Next, as shown in FIG. 21B, the skirt threads Y3 are put together around the suspension cord St, and are firmly tied together using another thread Y4 at the base portions of the skirt threads Y3 from which the suspension cord St extends. Next, the skirt threads Y3 are trimmed to even their ends. As a result, an ornament M (tassel) is obtained as shown in FIG. 21C.

When a tassel is made using the above ornament making assisting tool 9, if the pair of thread hanging portions on the shorter sides are used, a tassel having a longer skirt portion can be produced. If the pair of thread hanging portions on the longer sides are used, a tassel having a shorter skirt portion can be produced. The length of the tassel skirt portion is defined by the dimensions of the rectangular frame, and therefore, the ornament making assisting tool 9 cannot flexibly provide various lengths of skirt portions. In other words, for some skirt portion length of a tassel skirt threads having a large excess length are made, and a larger end portion of the skirt threads is trimmed. As a result, a large amount of skirt threads is trimmed away, and a large portion of the thread material used is wasted. In addition, as shown in FIG. 20, when the looped thread Y1 is cut, it is necessary to insert the scissors Sc between the thread hanging portion SI and the looped thread Y1, resulting in poor workability. Due to such poor workability, it takes a lot of time and effort for the user to make a large number of ornaments M.

SUMMARY OF THE INVENTION

The present invention has been proposed under the above circumstances. It is a main object of the present invention to provide an ornament making assisting tool that is suitable for making a tufted ornament.

According to an aspect of the present invention, there is provided an assisting tool for making a tufted ornament. The assisting tool includes first and second frames that are slidable with respect to each other in a first direction. The first and second frames include first and second thread hanging portions, respectively, which are spaced apart from each other in the first direction, and each thread hanging portion is elongated in a second direction perpendicular to the first direction. The assisting tool also includes a length adjuster that adjustably varies the length from the first thread hanging portion to the second thread hanging portion, where the length or distance is measured along the first direction.

In an embodiment, the first thread hanging portion and the second thread hanging portion have a first groove and a second groove, respectively, that are oppositely open in the first direction.

In an embodiment, each of the first thread hanging portion and the second thread hanging portion has a first end and a second end that are spaced apart from each other in the second direction. The first groove extends from the first end to the second end of the first thread hanging portion, and the second groove extends from the first end to the second end of the second thread hanging portion.

In an embodiment, the first frame includes a first extension and a second extension that are spaced apart from each other in the second direction and each of which extends from the first unread hanging portion in the first direction. Likewise, the second frame includes a third extension and a fourth extension that are spaced apart from each other in the second direction and each of which extends from the second thread hanging portion in the first direction. As viewed in a third direction perpendicular to both the first direction and the second direction, the first extension and the second extension overlap with the third extension and the fourth extension, respectively.

In an embodiment, the length adjuster includes: first positioning grooves spaced apart from each other in the first direction; a first protruding portion to be engaged with the first positioning grooves (one at a time); second positioning grooves spaced apart, from each ether in the first direction; and a second protruding portion to be engaged with the second positioning grooves (one at a time). The first positioning grooves are provided on either one of the first extension and the third extension, and the first protruding portion is provided on the other one of the first extension and the third extension. The second positioning grooves are provided on either one of the second extension and the fourth extension, and the second protruding portion is provided on the other one of the second extension and the fourth extension.

In an embodiment, the first positioning grooves each have a V-shaped cross-section, and the first protruding portion has a V-shaped cross-section that fits into the first positioning grooves. Likewise, the second positioning grooves each have a V-shaped cross-section, and the second protruding portion has a V-shaped cross-section that fits into with the second positioning grooves.

In an embodiment, the length adjuster is made up of a first elongated hole, a second elongated hole, a first threaded hole, a second threaded hole, a first fastening bolt and a second fastening bolt, where the first elongated bolt is provided in one of the first extension and the third extension and elongated in the first direction, the first threaded hole is provided in the other one of the first extension and the third extension and faces the first elongated hole, and the first fastening bolt extends through the first elongate hole to be screwed into the first threaded hole, and where the second elongated hole is provided in one of the second extension and the fourth extension and elongated in the first direction, the second threaded hole is provided in the other one of the second extension and the fourth extension and faces the second elongated hole, and the second fastening bolt extends through the second elongate hole to be screwed into the second threaded hole.

In an embodiment, the first elongated hole is formed in a region where the first positioning-grooves are provided, and the first threaded hole is provided at the first protruding portion. Likewise, the second elongated hole is formed in a region where the second positioning grooves are provided, and the second threaded hole is provided at the second protruding portion.

In an embodiment, one of the first extension and the third extension is provided with first markers, and one of the second extension and the fourth extension is provided with second markers, where one of the first markers and one of the second markers are located at a center in the first direction between the first thread hanging portion, and the second thread hanging portion when the first protruding portion is engaged with one of the first positioning grooves, and the second protruding portion is engaged with one of the second positioning grooves.

In an embodiment, the first extension is offset from the second extension in the third direction, and the third extension is offset from the fourth extension in the third direction. The first frame and the second frame may be identical or generally identical in structure to each other in a manner such that the first extension corresponds to the fourth extension, while the second extension corresponds to the third extension.

Other features and advantages of the present invention will be apparent from the detailed description given below with reference to the accompanying drawings.

DETAILED DESCRIPTION OF THE PREFERRED EMBODIMENTS

Figure 1:
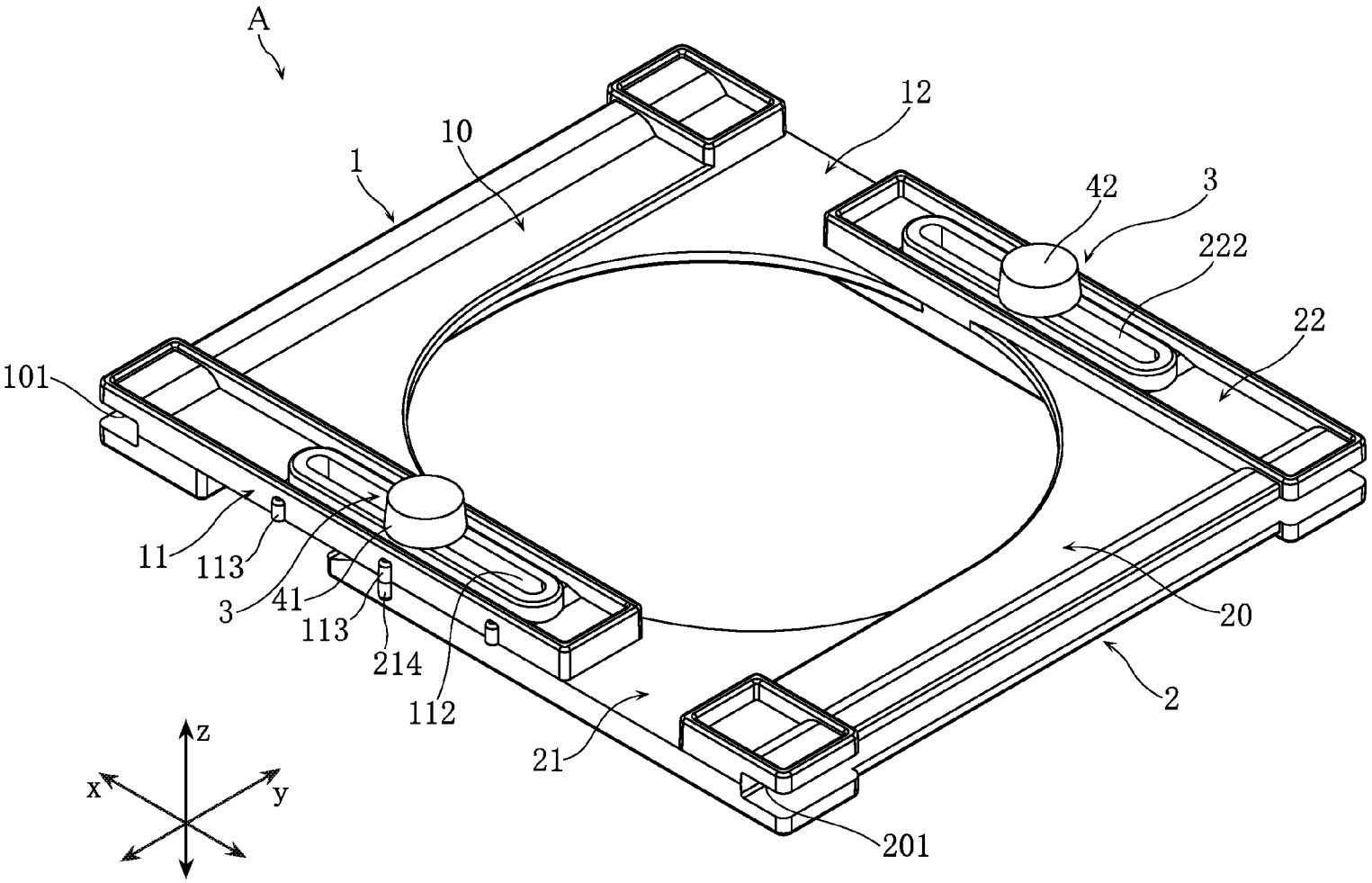
FIG. 1 is a perspective view showing an example ornament making assisting tool according to the present invention.

Preferred embodiments of the present invention will be described below with reference to the accompanying drawings.

FIGS. 1-11 show an embodiment, of an ornament making assisting tool according to an aspect or the present invention. As can be seen from FIGS. 1 and 2, the ornament making assisting tool A of this embodiment includes a first frame 1, a second frame 2, and a length or distance adjuster 3. The ornament making assisting tool A of this embodiment may be used to make a tassel, for example.

The first and second frames 1 and 2 as assembled are in the shape of a generally rectangular frame. The first, frame 1 has a first thread hanging portion 10, and two extensions 11 and 12. Similarly, the second frame 2 has a second thread hanging portion 20, and two extensions 21 and 22.

The first and second thread hanging portions 10 and 20 are a portion around which a thread material is wound when a tassel is made. The first and second thread hanging portions 10 and 20 are separated from each other in a direction x, and each hanging portion 10, 20 extends in a direction y that is perpendicular to the x direction.

As shown in FIGS. 4, 5, 7, and 8, the first thread hanging portion 10 has a groove 101, and the second thread hanging portion 20 has a groove 201. The grooves 101 and 201 are open outward in the x direction, opposite to each other. Each groove 101, 201 extends in the y direction from one end of the thread hanging portion 10, 20 to the other end, so that the opposite ends in the y direction of the groove 101, 201 are both open.

Figure 2:
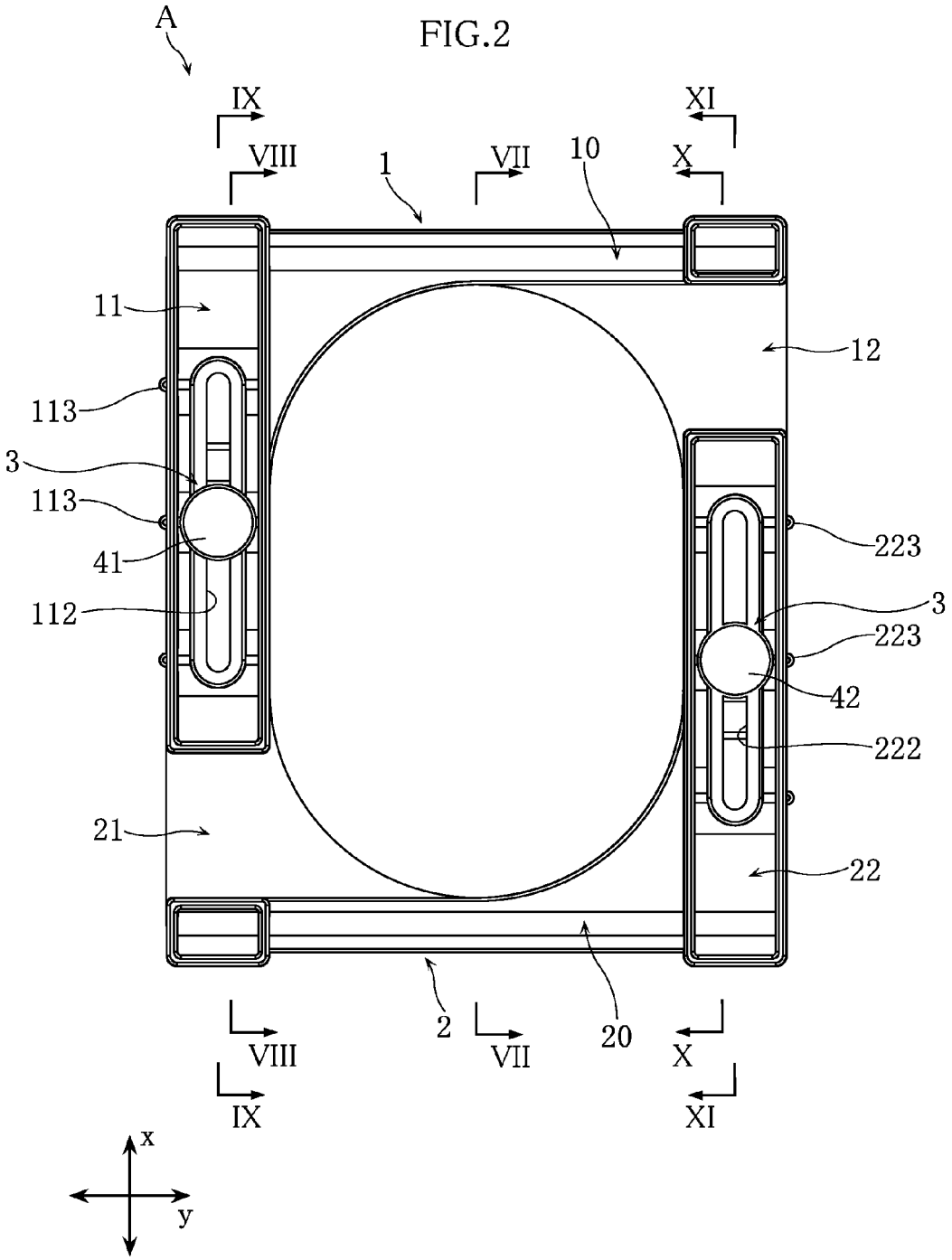
FIG. 2 is a plan view of the ornament making assisting tool of FIG. 1.
Figure 3:
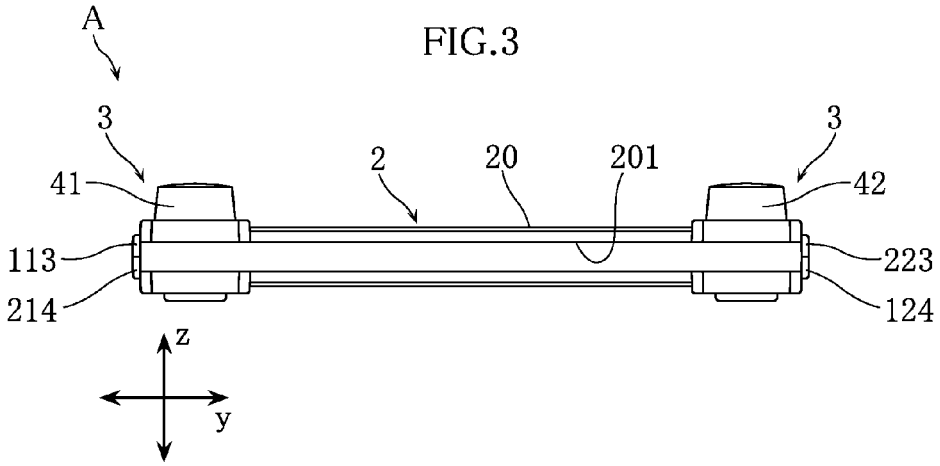
FIG. 3 is a front view of the ornament making assisting tool of FIG. 1.

As shown in FIGS. 1 and 2, the extensions 11 and 12 extend in the x direction from the respective opposite ends in the y direction of the first thread hanging portion 10.

The extensions 21 and 22 extend in the x direction from the respective opposite ends in the y direction of the second thread hanging portion 20. The extensions 21 and 22 (of the second frame 2) overlap with the extensions 11 and 12 (of the first frame 1), respectively, as viewed in the thickness direction, or z direction, that is perpendicular to both the x direction and y direction.

In this embodiment, the first and second frames 1 and 2 have the same structure, where the extension 11 of the first frame 1 corresponds to the extension 22 of the second frame 2, and the extension 12 of the first frame 1 corresponds to the extension 21 of the second frame 2. In the illustrated embodiment, the extension 11 is displaced or offset upward in the thickness direction with respect, to the other extension 12 (which in turn is displaced downward in the thickness direction with respect to the extension 11). Likewise, the extension 21 of the second frame 2 is displaced downward in the thickness direction with respect to the other extension 22. The first and the second frames 1 and 2 overlap exactly with each other when one is rotated by 180 degrees relative to the other about a center axis parallel to the z axis. Due to this configuration, the extensions 21 and 22 of the second frame 2 overlap with the extensions 11 and 12 of the first frame 1, respectively, as viewed in the thickness direction, as described above. The first and second frames 1 and 2 may be made of a synthetic resin such as acrylonitrile-butadiene-styrene (ABS) resin, for example, so as to have a required mechanical strength.

Figure 8:
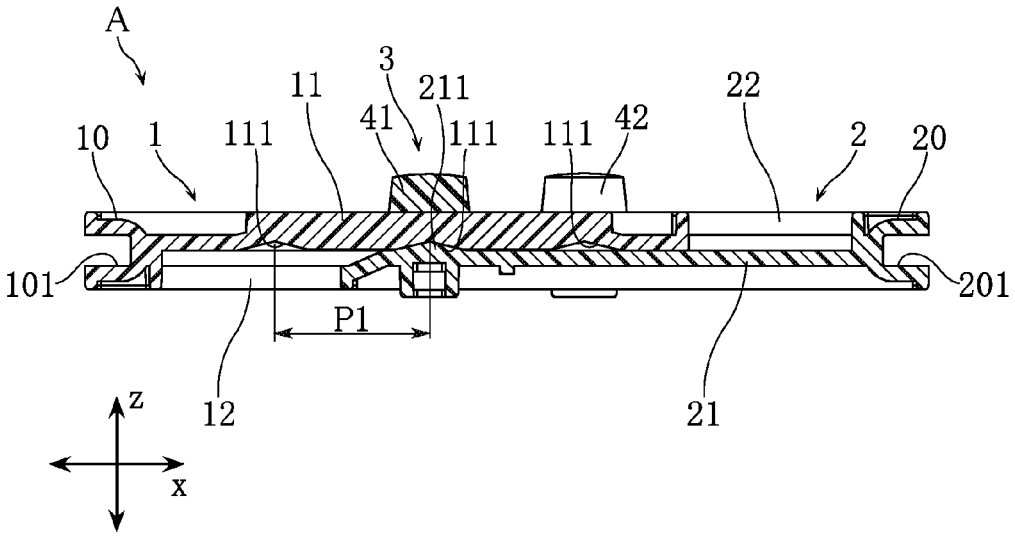
FIG. 8 is a cross-sectional view taken along line VIII-VIII of FIG. 2.
Figure 9:
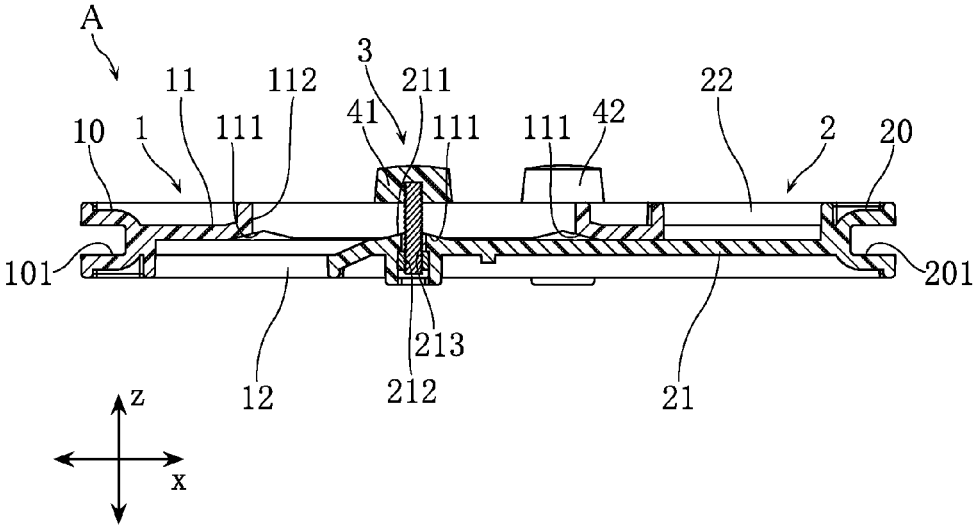
FIG. 9 is a cross-sectional view taken along line IX-IX of FIG. 2.

As shown in FIGS. 2, 8, and 9, the extension 11 of the first frame 1 has a plurality of positioning grooves 111 and an elongated hole 112. The plurality of (three in this embodiment) grooves 111 are formed on the lower surface of the extension 11. Each groove 111 has a V-shaped cross-section. The grooves 111 are arranged in the x direction, in parallel with each other, at a predetermined pitch P1. The pitch P1 between grooves 111 is, for example, a constant and about 2 cm. The elongated hole 112, which penetrates in the thickness direction and extends in the x direction, is provided partially in a region where the grooves 111 are formed.

The extension 21 of the second frame 2 has a protruding portion 211. The protruding portion 211 is formed on the upper surface of the extension 21. The protruding portion 211, which has a Y-shaped cross-section, can be engaged with each groove 111 of the extension 11.

As shown in FIG. 9, the extension 21 has a threaded hole 212 that is open upward. In this embodiment, the threaded hole 212 is provided in a region where the protruding portion 211 is formed. For example, a hole 213 that penetrates vertically is formed in the extension 21 at the center of the protruding portion 211. The threaded hole 212 is provided by inserting a nut having the threaded hole 212 into the hole 213 from below the protruding portion 211. As can be seen from FIG. 9, the threaded hole 212 faces the elongated hole 112, and a fastening bolt 41 is screwed into the threaded hole 212 through the elongated hole 112 from above in in the thickness direction.

Figure 4:
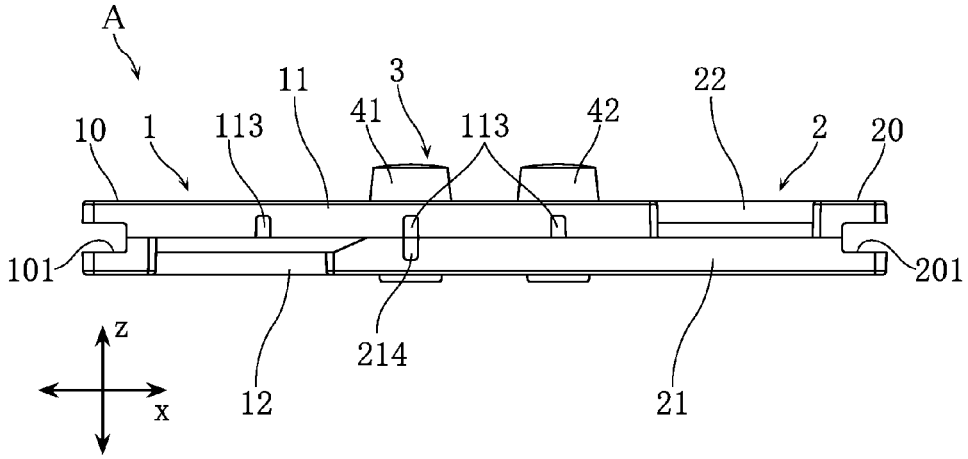
FIG. 4 is a left side view of the ornament making assisting tool of FIG. 1.

As shown in FIGS. 2 and 4, a plurality of markers 113 are formed on the outer surface of the extension 11, protruding from the outer surface. The markers 113 are located at positions corresponding to the respective grooves 111, and are arranged at the same pitch as the pitch P1 of the grooves 111. A marker 214 is formed on the outer surface of the extension 21, protruding from the outer surface. The marker 214 is located at a position corresponding to the protruding portion 211.

Figure 10:
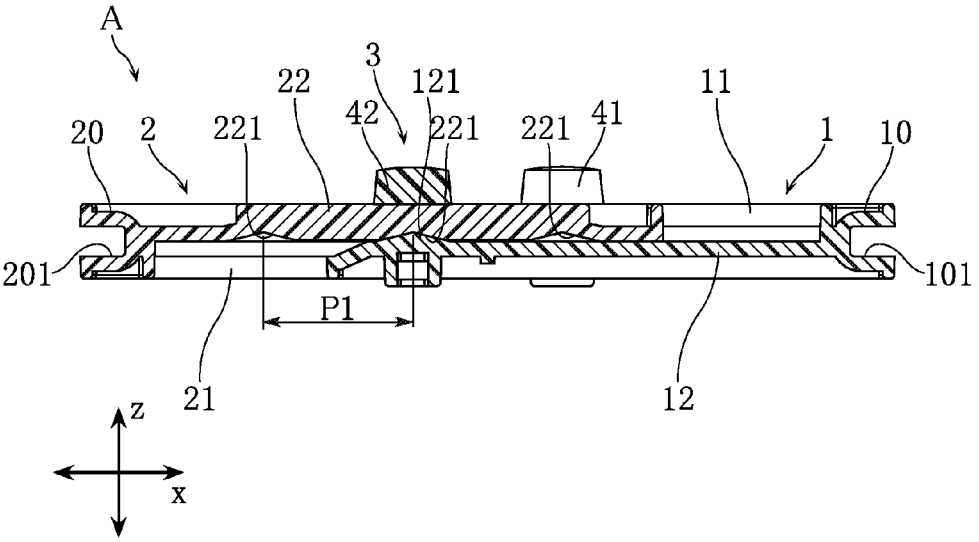
FIG. 10 is a partial cross-sectional view taken along line X-X of FIG. 2.
Figure 11:
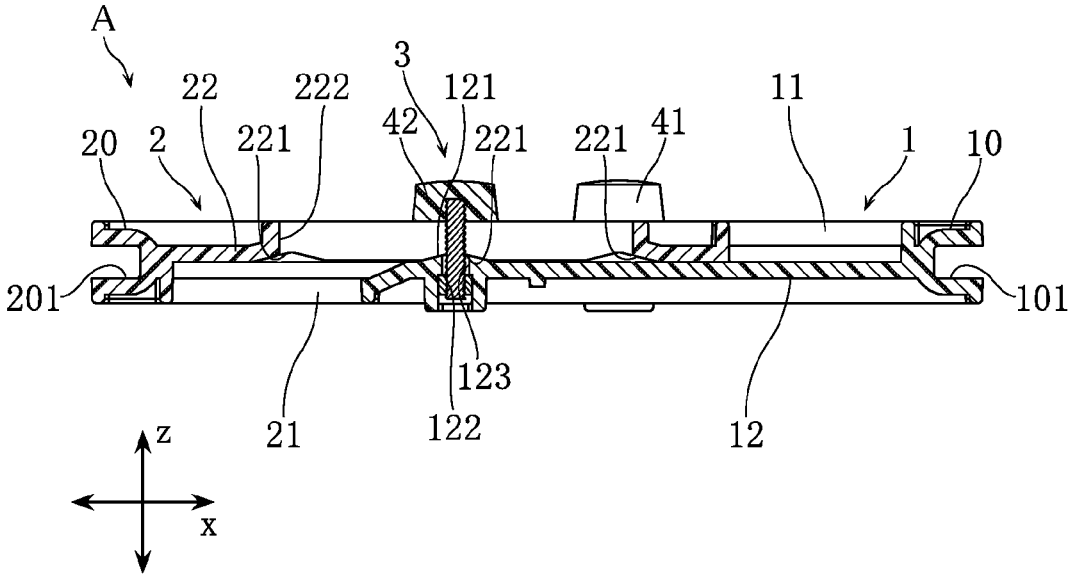
FIG. 11 is a partial, cross-sectional view taken along line XI-XI of FIG. 2.

As shown in FIGS. 2, 10, and 11, the extension 22 of the second frame 2 has a plurality of positioning grooves 221 and an elongated hole 222. The plurality of (three in this embodiment) grooves 221 are formed on the lower surface of the extension 22. Each groove 221 has a V-shaped cross-section. The grooves 221 are arranged in the x direction. The grooves 221 are arranged in the x direction at a predetermined pitch P1. The pitch (P1) of the grooves 221 is the same as the pitch (P1) of the grooves 111. The elongated hole 222, which penetrates in in the thickness direction and extends in the x direction, is provided partially in a region where the grooves 221 are formed.

The extension 12 of the first frame 1 has a protruding portion 121. The protruding pore ion 121 is formed on the upper surface of the extension 12. The protruding portion 121, which has a V-shaped cross-section, can be engaged with each groove 221 of the extension 22.

As shown in FIG. 11 the extension 12 has a threaded hole 122 that is open upward. In this embodiment, the threaded hole 122 is provided in a region where the protruding portion 121 is formed. For example, a hole 123 that penetrates vertically is formed in the extension 12 at the center of the protruding portion 121. For example, the threaded hole 122 is provided by inserting a nut having the threaded hole 122 into the hole 123 from below the protruding portion 121. As can be seen from FIG. 11, the threaded hole 122 faces the elongated bole 222, and a fastening bolt 42 is screwed into the threaded hole 122 through the elongated hole 222 from above in a thickness direction along the z axis.

Figure 5:
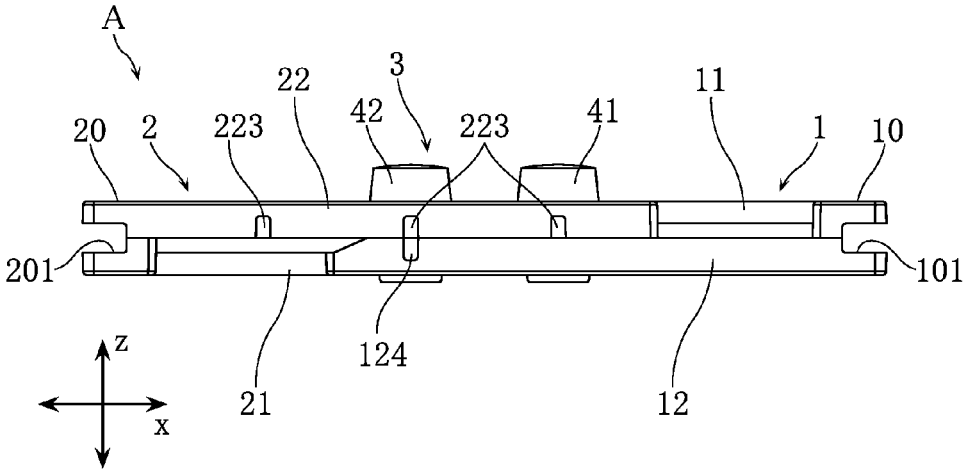
FIG. 5 is a right side view of the ornament making assisting tool of FIG. 1.

As shown in FIGS. 2 and 5, a plurality of markers 223 are formed on the outer surface of the extension 22, protruding from the outer surface. The markers 223 are located at positions corresponding to the respective grooves 221, and are arranged at the same pitch as the pitch P1 of the grooves 221. A marker 124 is formed on the outer surface of the extension 12, protruding from the outer surface. The marker 124 is located at a position corresponding to the protruding portion 121.

As can be understood from the above configuration, the relative positions in the x direction of the extension 11 of the first frame 1 and the extension 21 of the second frame 2 can be changed in a stepwise manner in units of the pitch P1. Also, the relative positions in the x direction of the extension 22 of the second frame 2 and the extension 12 of the first frame 1 can be changed in a stepwise manner in units of the pitch P1. Thus, the length in the x direction from the first thread hanging portion 10 of the first frame 1 to the second thread hanging portion 20 of the second frame 2 can be adjusted in a stepwise manner.

The grooves 111 and the elongated hole 112 provided in the extension 11, the protruding portion 211 and the threaded hole 212 provided in the extension 21, the grooves 221 and the elongated hole 222 provided in the extension 22, the protruding portion 121 and the threaded hole 122 provided in the extension 12, and the fastening bolts 41 and 42 screwed into the threaded holes 212 and 122, constitute the length adjuster 3.

Figure 6:
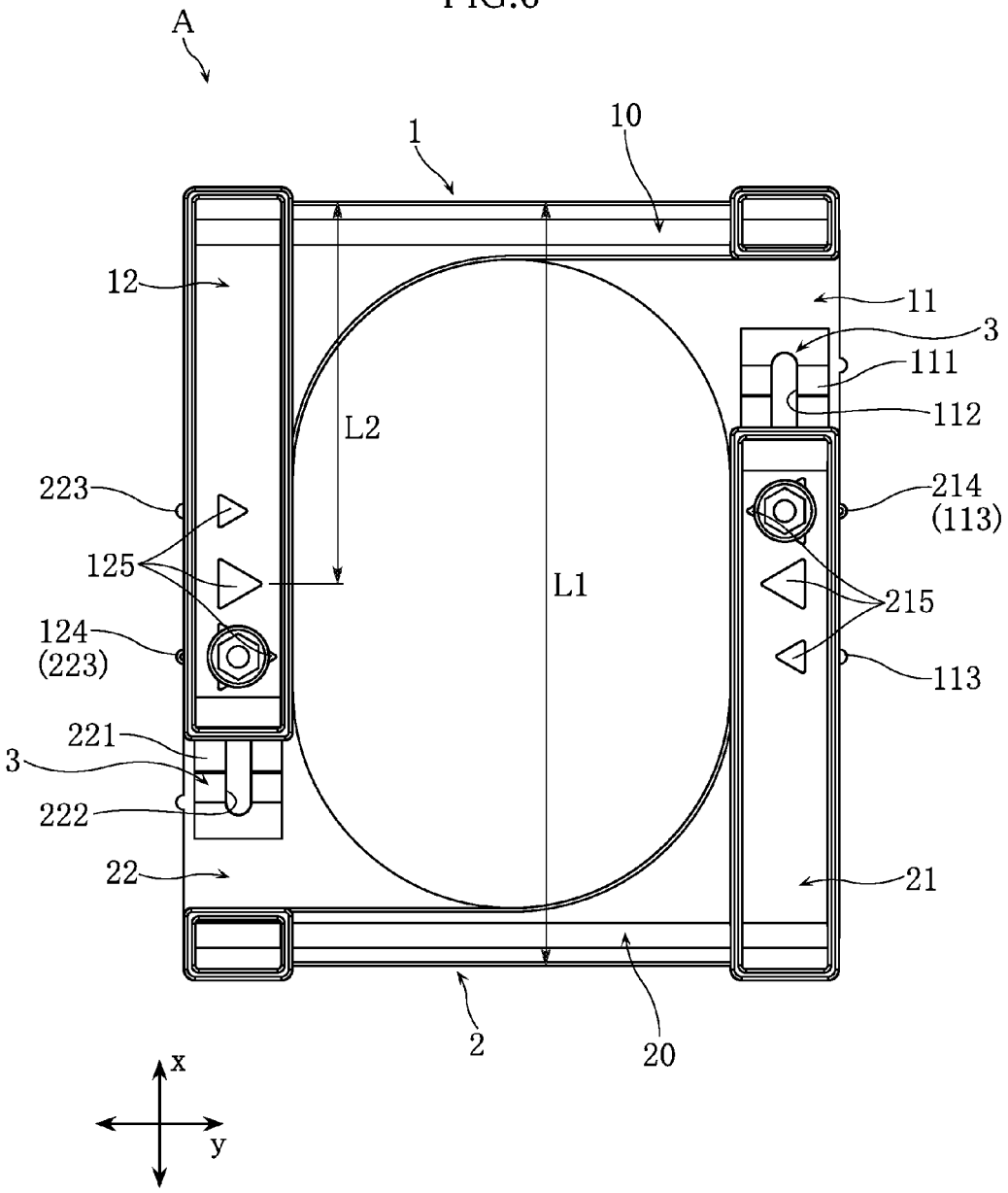
FIG. 6 is a bottom view of the ornament making assisting tool of FIG. 1.
Figure 7:
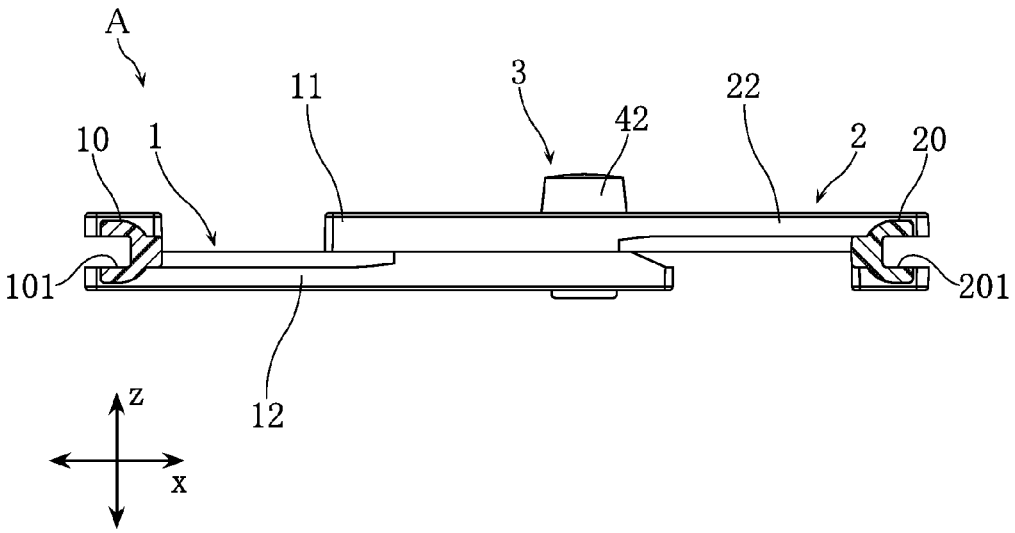
FIG. 7 is a cross-sectional view taken along line VII-VII of FIG. 2.

As shown in FIG. 6, a plurality of (three in this embodiment) markers 215 (first markers) are provided on the lower surface of the extension 21. A plurality of (three in this embodiment) markers 125 (second markers) are provided on the lower surface of the extension 12.

The first markers 215 and the second markers 125 are arranged in the x direction at a predetermined pitch. The pitch between the first markers 215 or the second markers 125 is about 1 cm, which is half the pitch P1 of the grooves 111 and 221.

When the protruding portion 211 is engaged with one of the grooves 111 and the protruding portion 121 is engaged with one of the grooves 221, one of the markers 215 and one of the markers 125 are located at a middle position in the x direction between the first and second thread hanging portions 10 and 20. In the state shown in FIG. 6, the protruding portions 211 and 121 are engaged with the second grooves 111 and 221 as counted from above in the x direction. In this case, the length L1 between outer edges of the first and second thread hanging portions 10 and 20 is about 10.4 cm. In addition, the second markers 215 and 125 as counted from above are located at the middle position in the x direction between the first and second thread, hanging portions 10 and 20. The length L2 from the outer edge of the first thread hanging portion 10 to the second markers 215 and 125 as counted from above is half the length L1, i.e., about 5.2 cm.

The ornament making assisting tool A of this embodiment is configured to make a tassel with a skirt portion having a length of 3 cm, 4 cm, or 5 cm. The ornament making assisting tool A shown in FIGS. 1-11 is set to make a tassel with a skirt portion having a length of 4 cm.

To make a tassel with a skirt portion having a length of 3 cm, the length L1 from the first thread hanging portion 10 to the second thread hanging portion 20 is set to the lowest value, i.e., the length L1 is set to about 8.4 cm. When the length L1 is set to the lowest value, the protruding portion 211 is engaged with the groove 111 closest to the first thread hanging portion 10 while the protruding portion 121 is engaged with the groove 221 closest to the second thread hanging portion 20. In addition, when the length L1 is set to the lowest value, the first ones of the markers 215 and 125 shown in FIG. 6, as counted from, above, are located at the middle position in the x direction between the first and second thread hanging portions 10 and 20.

To make a tassel with a skirt portion having a length of 5 cm, the length L1 from the first hanging portion 10 to the second thread hanging portion 20 is set to the greatest value, i.e., the length L1 is set to about 12.4 cm. When the length L1 is set to the greatest value, the second protruding portion 211 is engaged with the groove 111 farthest from the first thread hanging portion 10 while the protruding portion 121 is engaged with the groove 221 farthest from the second thread hanging portion 20. In addition, when the length L1 is set to the greatest value, the third ones of the markers 215 and 125 shown in FIG. 6, as counted from above, are located at the middle position in the x direction between the first and second thread hanging portions 10 and 20.

A method for making a tassel using the ornament making assisting tool A will be described below with reference to FIGS. 12-16.

Initially, the length or distance (L1) in the x direction from the first thread hanging portion 10 to the second thread hanging portion 20 is adjusted, depending on the length of the skirt portion of a finished tassel that will be made. The length L1 is adjusted while the fastening bolts 41 and 42 are untightened so that the protruding portions 211 and 121 are not engaged with any of the grooves 111 and 222. Thereafter, the first and second thread hanging portions 10 and 20 are relatively moved closer to or farther from each other in the x direction. Here, the fastening bolts 41 and 42 penetrate through the elongated holes 112 and 222 so that the first, and second frames 1 and 2 are allowed to slide toward or away from each other in the x direction. After changing the length L1, the fastening bolts 41 and 42 are tightened to fasten the first and second frames 1 and 2 to each other.

Figure 12:
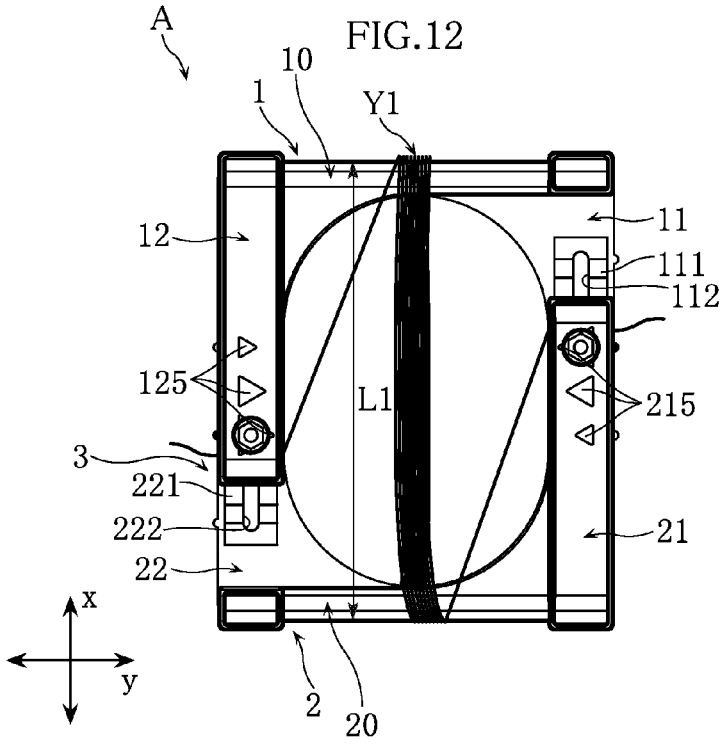
FIG. 12 is a diagram for describing a method for making an ornament using an ornament making assisting tool according to the present invention.

Next, as shown in FIG. 12, the ornament making assisting tool A is turned over, and a thread material, such as an embroidery thread or the like, is wound an appropriate number of times around the first and second thread hanging portions 10 and 20 to form a looped thread Y1. Here, before the thread material starts being wound, the fastening bolt 42 may be temporarily slightly untightened, and an end of the thread material may be tucked in between the first and second frame extensions 12 and 22. Alternatively, after the looped thread Y1 is formed, the fastening bolt 41 may be temporarily slightly untightened, and an end of the thread material may be tucked in between the first and second frame extension 11 and 21.

Figure 13:
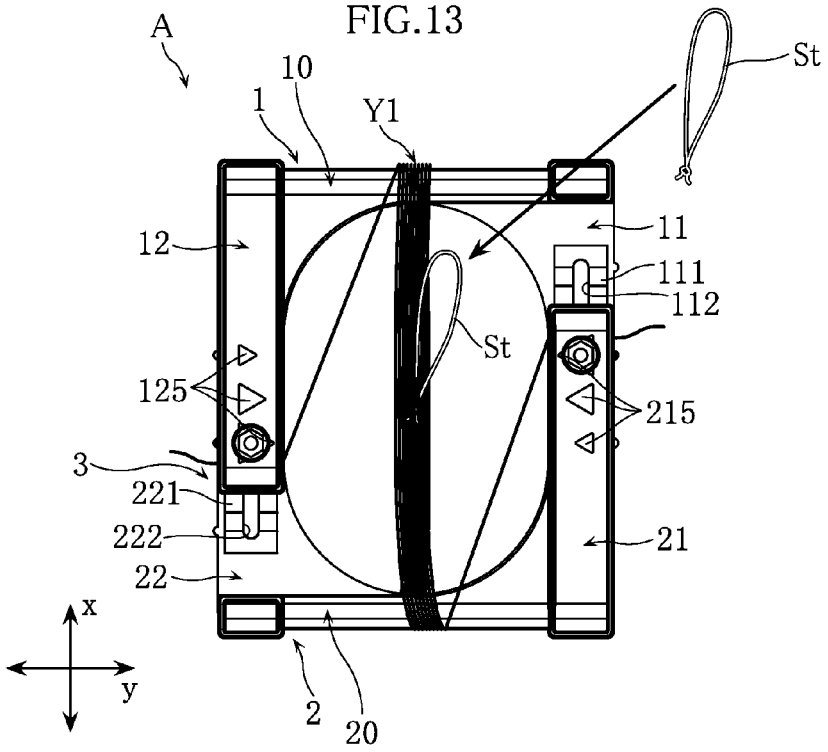
FIG. 13 is a diagram showing a step following FIG. 12.
Figure 14:
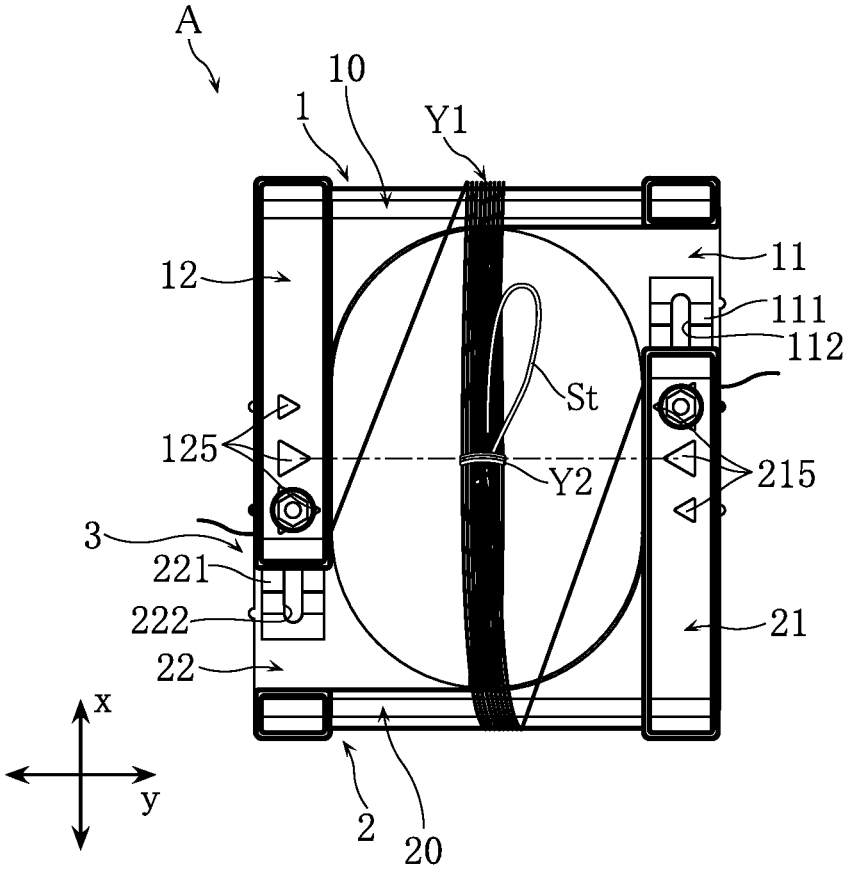
FIG. 14 is a diagram showing a step following FIG. 13.
Figure 15:
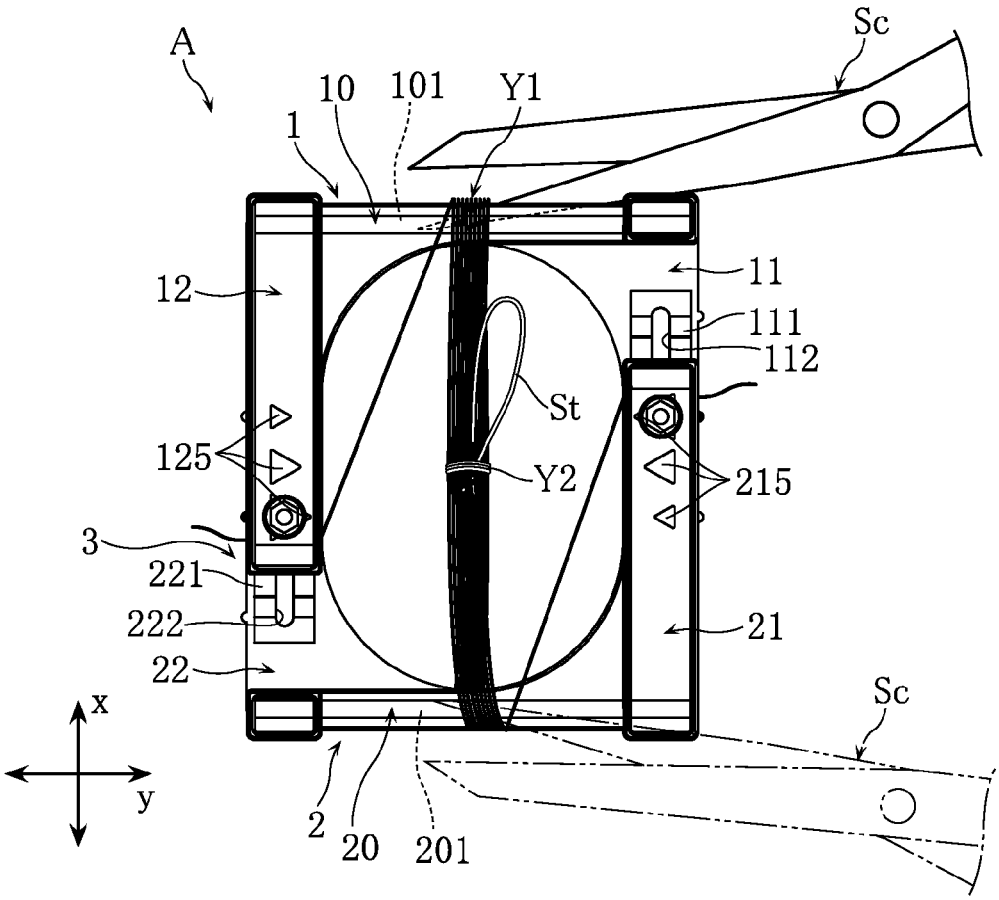
FIG. 15 is a diagram showing a step following FIG. 14.
Figure 16A:
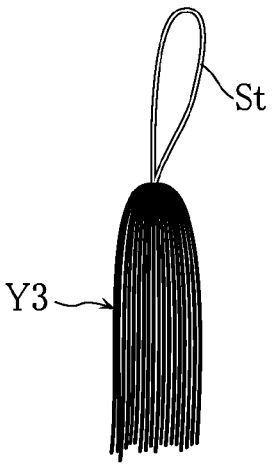
FIGS. 16A-16C are diagrams showing steps following FIG. 15.
Figure 16B:
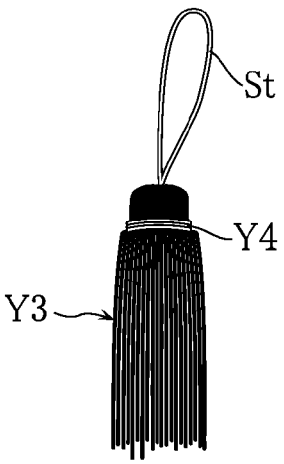
Figure 16C:
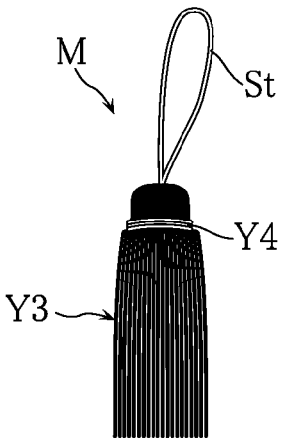
Figure 17:
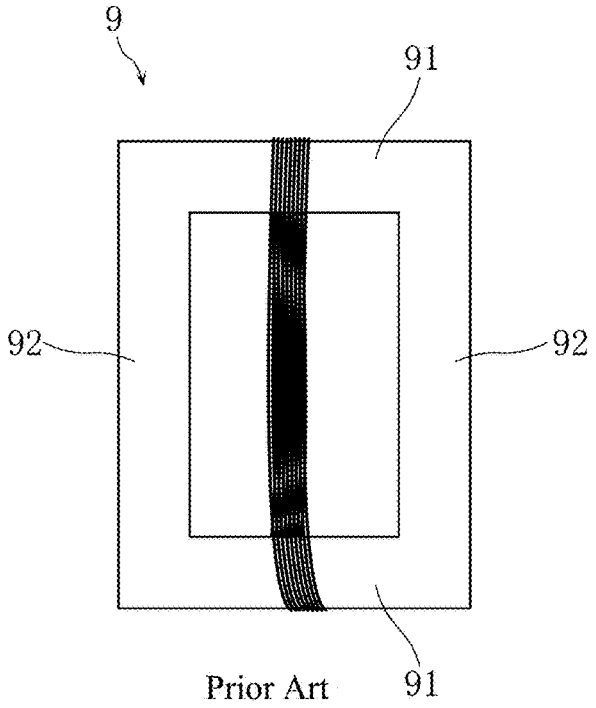
FIG. 17 is a diagram for describing a method for making an ornament using a conventional ornament making assisting tool.
Figure 18:
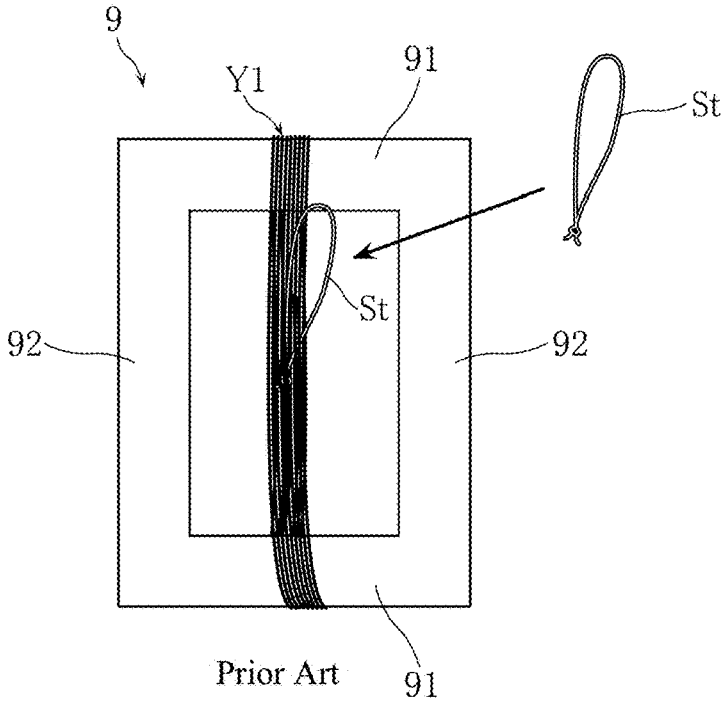
FIG. 18 is a diagram showing a step following FIG. 17.
Figure 19:
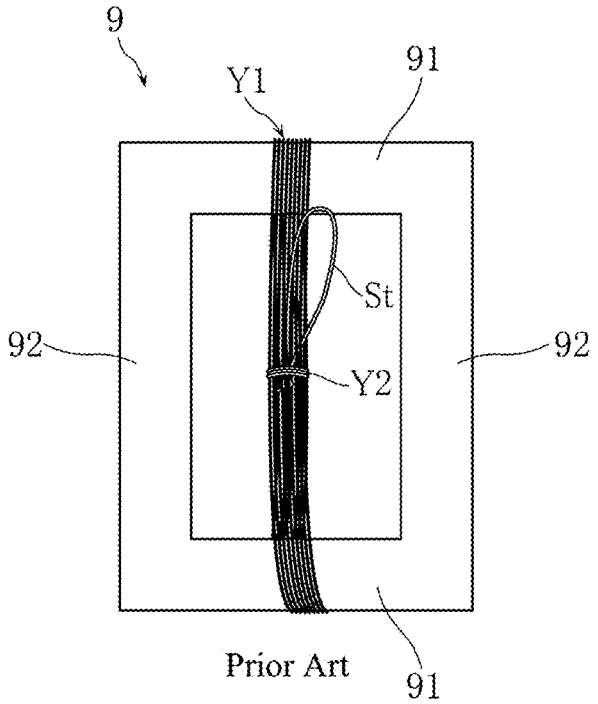
FIG. 19 is a diagram showing a step following FIG. 18.
Figure 20:
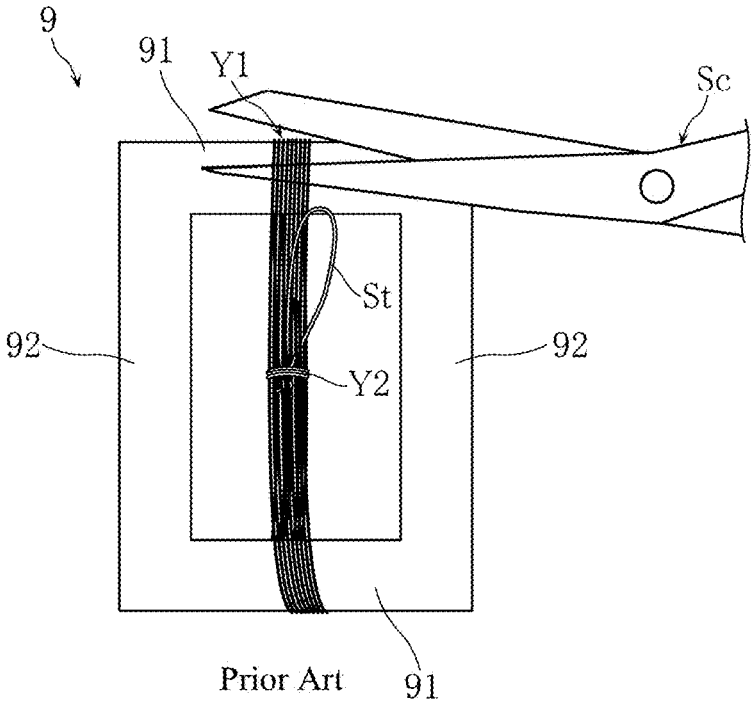
Prior Art FIG.20
FIG. 20 is a diagram showing a step following FIG. 19.
Figure 21A:
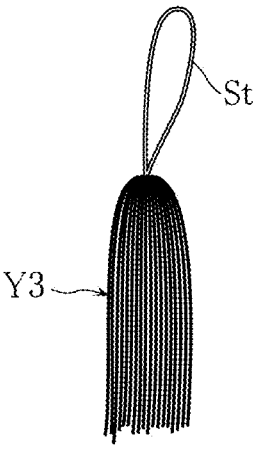
FIGS. 21A-21C are diagrams showing steps following FIG. 20.
Figure 21B:
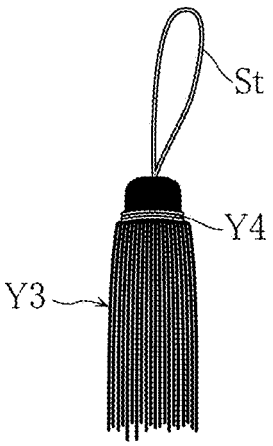
Prior Art FIG.21B
Figure 21C:
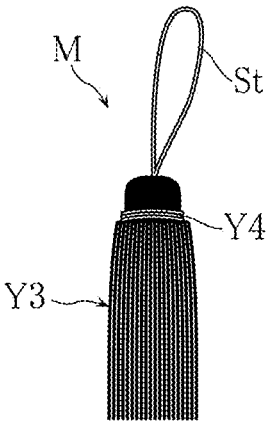
Prior Art FIG.21C

Next, as shown in FIG. 13, a ring-shaped suspension cord St having a knot is prepared, and the knot of the suspension cord St is buried in the looped thread Y1. Next, as shown in FIG. 14, a central portion in the x direction of the looped thread Y1 and the suspension cord St are firmly tied together using another thread Y2. Here, the central portion in the x direction of the looped thread Y1 can be easily determined using the markers 215 and 125 (the second markers 215 and 125 as counted from above in FIG. 14) as a guide. Next, as shown in FIG. 15, for example, a pair of scissors Sc are inserted into the groove 101 of the thread hanging portion 10 and the groove 201 of the second thread hanging portion 20, and the looped thread Y1 is cut at two locations where the thread is wrapped around the first and second thread hanging portions 10 and 20. This cutting provides skirt threads Y3 as shown, in FIG. 16A. Next, as shown in FIG. 16B, the skirt threads Y3 are put together around the suspension cord St, and are firmly tied together using another thread 14 at the base portions of the skirt threads Y3 from which the suspension cord St extends. Next, the skirt threads Y3 are trimmed to even their ends. As a result, an ornament M (tassel) is obtained as shown in FIG. 16C.

Next, advantages of the ornament making assisting tool will be described.

The ornament making assisting tool A of this embodiment includes the length adjuster 3. The length adjuster 3 is used for adjustably varying the length in the x direction from the first hanging portion 10 to the second thread hanging portion 20. Such a configuration allows for adjustment of the length in the x direction from the first hanging portion 10 to the second thread hanging portion 20, in accordance with the length of the skirt portion of a tassel that will be made. Therefore, the amount of skirt threads that are trimmed to even their ends can be substantially reduced. As a result, the amount of a thread material that is used can be reduced.

The first and second thread hanging portions 10 and 20 have the grooves 101 and 201. The grooves 101 and 201 are open outward in the x direction along which the first and second thread hanging portions 10 and 20 are separated from each other. Such a configuration allows a cutting tool, such as a pair of scissors Sc or the like, to be inserted in the grooves 101 and 201 when a tassel is made, as described above with reference to FIG. 15. Therefore, the looped thread Y1 can be easily cut, and therefore, a tassel can be efficiently made.

The grooves 101 and 201 extend from one end in the y direction of the first and second thread hanging portions 10 and 20 to the other. Such a configuration allows a cutting tool, such as a pair of scissors or the like, to easily be inserted in the grooves, resulting in good workability.

The first frame 1 has the extensions 11 and 12 that extend from opposite ends in the extending direction (along the y axis) of the first thread hanging portion 10, perpendicularly to the extending direction. The second frame 2 has the extensions 21 and 22 that extend from opposite ends in the extending direction (along the y axis) of the second thread hanging portion 20, perpendicularly to the extending direction. The extensions 11 and 12 overlap with the extensions 21 and 22, respectively. Such a configuration allows the first and second thread hanging portions 10 and 20 to be kept parallel or substantially parallel to each other even when the first and second frames 1 and 2 are slid toward or away from each other.

The length adjuster 3 has the grooves 111 and 221 provided on the first and second frame extensions 11 and 22, and the protruding portions 211 and 121 provided on the second and first frame extensions 21 and 12. The grooves 111 (221) are arranged in the x direction at the predetermined pitch P1, and the protruding portion 211 (121) can be engaged with the grooves 111 (221). Such a configuration can change the relative positions in the x direction of the first and second thread hanging portions 10 and 20 in a stepwise manner.

The grooves 111 formed on the extension 11 each have a V-shaped cross-section, and are arranged in the x direction. The grooves 221 formed on the extension 22 each have a V-shaped cross-section, and are arranged in the x direction.

The protruding portions 211 and 121 formed on the second and first frame extensions 21 and 12 have a V-shaped cross-section that allows the protruding portions 211 and 121 to engage with the grooves 111 and 221. With such a configuration, even when the groove 111 (221) and the protruding portion 211 (121) axe not at the predetermined relative positions in the x direction where they are to engage with each other, the groove 111 (221) and the protruding portion 211 (121) are easily guided to the predetermined relative positions during the course of engagement. The relative positions in the x direction of the first and second thread hanging portions 10 and 20 can be easily changed in a stepwise manner.

The protruding portions 211 and 121 are fastened to the grooves 111 and 221 by screwing the fastening bolts 41 and 42 into the threaded holes 212 and 122 facing the elongated holes 112 and 222. Such a configuration allows the protruding portion 211 (121) and the groove 111 (221) to easily switch between the state where the protruding portion 211 (121) and the groove 111 (221) are fastened to each other and the state where the protruding portion 211 (121) and the groove 111 (221) are not fastened to each other.

The elongated hole 112 (222) is provided partially in a region where the grooves 111 (221) are formed, and the threaded hole 212 (122) is provided in a region where the protruding portion 211 (121) is formed. As a result, when the fastening bolt 41 (42) is tightened, the axial force of the screw portion is efficiently used so that the protruding portion 211 (121) and the groove 111 (221) are fastened to each other. Such a configuration allows the protruding portion 211 (121) and the groove 111 (221) to reliably fasten to each other.

The markers 215 (first markers) are provided on the extension 21, and the markers 125 (second markers) are provided on the extension 12. When the protruding portion 211 is engaged with one of the grooves 111 and the protruding portion 121 is engaged with one of the grooves 221, one of the markers 215 and one of the markers 125 are located at a middle position in the x direction between the first and second thread hanging portions 10 and 29. With such a configuration, as described above with reference to FIG. 14, when a tassel is made, it is easy to determine the central portion in the x direction of the looped thread Y1 wound around the first and second thread hanging portions 10 and 20 using the markers 215 and 125 as a guide. Therefore, it is easy to tie the central portion in the x direction of the looped thread Y1 with the thread Y2, and therefore, a tassel can be efficiently made.

The first and second frames 1 and 2 are composed of the same members. Specifically, the extension 11 corresponds to the extension 22, and the extension 12 corresponds to the extension 21. The extension 11 is displaced upward in a thickness direction along the z axis while the extension 12 is displaced downward in the thickness direction. The extension 21 is displaced downward in the thickness direction while the extension 22 is displaced upward in the thickness direction. In addition, the extensions 11 and 12 overlap with the extensions 21 and 22, respectively, as viewed in in the thickness direction. Thus, the two members (the first and second frames 1 and 2) have the same members, and therefore, the manufacturing cost of the ornament making assisting tool A can be reduced. If the first and second frames 1 and 2 have the same members, it is easy to handle the ornament making assisting tool A.

Although specific embodiments of the present invention have been described above, the present invention is not limited to these embodiments. Various changes and modifications may be made without departing from the scope and spirit of the present invention. Specific shapes, materials, and the like of the ornament making assisting tool of the present invention are not limited to the above embodiments.

In the above embodiments, there are three positioning grooves 111 or 221 arranged along the x direction for each frame. The present invention is not limited to this, and use may be made of four or more positioning grooves for each frame. As the number of grooves 111, 221 increases, the length in the x direction between the first and second thread hanging portions can be adjusted to a greater number of different values.

The invention claimed is:

1. An assisting tool for making a tufted ornament, the tool comprising:

a first frame and a second frame that are slidable with respect to each other and include a first thread hanging portion and a second thread hanging portion, respectively, the first thread hanging portion and the second thread hanging portion being spaced apart from each other in a first direction, each of the first thread hanging portion and the second thread hanging portion being elongated in a second direction perpendicular to the first direction; and a length adjuster that adjustably varies a length in the first direction from the first thread hanging portion to the second thread hanging portion, wherein the first frame includes a first extension and a second extension that are spaced apart from each other in the second direction and each of which extends from the first thread hanging portion in the first direction, the second frame includes a third extension and a fourth extension that are spaced apart from each other in the second direction and each of which extends from the second thread hanging portion in the first direction, as viewed in a third direction perpendicular to both the first direction and the second direction, the first extension and the second extension overlap with the third extension and the fourth extension, respectively, the first extension and the third extension are slidable relative to each other along an imaginary plane perpendicular to the third direction, and the second extension and the fourth extension are slidable relative to each other along the imaginary plane.

2. The assisting tool according to claim 1, wherein the first thread hanging portion and the second thread hanging portion have a first groove and a second groove, respectively, that are oppositely open in the first direction.

3. The assisting tool according to claim 2, wherein each of the first thread hanging portion and the second thread hanging portion has a first end and a second end that are spaced apart from each other in the second direction, the first groove extends from the first end to the second end of the first thread hanging portion, and the second groove extends from the first end to the second end of the second thread hanging portion.

4. The assisting tool according to claim 1, wherein the length adjuster includes: first positioning grooves spaced apart from each other in the first direction; a first protruding portion to be engaged with the first positioning grooves; second positioning grooves spaced apart from each other in the first direction; and a second protruding portion to be engaged with the second positioning grooves, the first positioning grooves are provided on one of the first extension and the third extension, and the first protruding portion is provided on the other one of the first extension and the third extension, the second positioning grooves are provided on one of the second extension and the fourth extension, and the second protruding portion is provided on the other one of the second extension and the fourth extension.

5. The assisting tool according to claim 4, wherein the first positioning grooves each have a V-shaped cross-section, and the first protruding portion has a V-shaped cross-section that fits into the first positioning grooves, the second positioning grooves each have a V-shaped cross-section, and the second protruding portion has a V-shaped cross-section that fits into with the second positioning grooves.

6. The assisting tool according to claim 4, wherein the length adjuster comprises a first elongated hole, a second elongated hole, a first threaded hole, a second threaded hole, a first fastening bolt and a second fastening bolt, the first elongated hole is provided in one of the first extension and the third extension and elongated in the first direction, the first threaded hole is provided in the other one of the first extension and the third extension and faces the first elongated hole, and the first fastening bolt extends through the first elongate hole to be screwed into the first threaded hole, the second elongated hole is provided in one of the second extension and the fourth extension and elongated in the first direction, the second threaded hole is provided in the other one of the second extension and the fourth extension and faces the second elongated hole, and the second fastening bolt extends through the second elongate hole to be screwed into the second threaded hole.

7. The assisting tool according to claim 6, wherein the first elongated hole is formed in a region where the first positioning grooves are provided, and the first threaded hole is provided at the first protruding portion, the second elongated hole is formed in a region where the second positioning grooves are provided, and the second threaded hole is provided at the second protruding portion.

8. The assisting tool according to claim 4, wherein one of the first extension and the third extension is provided with first markers, and one of the second extension and the fourth extension is provided with second markers, one of the first markers and one of the second markers are located at a center in the first direction between the first thread hanging portion and the second thread hanging portion with the first protruding portion engaged with one of the first positioning grooves and with the second protruding portion engaged with one of the second positioning grooves.

9. The assisting tool according to claim 1, wherein the first extension is offset from the second extension in the third direction, and the third extension is offset from the fourth extension in the third direction, the first frame and the second frame are identical in structure to each other, the first extension corresponding to the fourth extension, the second extension corresponding to the third extension.

* * * * *